US006786460B1

(12) United States Patent
Kelly

(10) Patent No.: US 6,786,460 B1
(45) Date of Patent: Sep. 7, 2004

(54) COMBINATION CARRYING STRAP AND SUPPORT STAND

(76) Inventor: David Scott Kelly, 5 Fisher Ave., Swampscott, MA (US) 01907

( * ) Notice: Subject to any disclaimer, the term of this patent is extended or adjusted under 35 U.S.C. 154(b) by 0 days.

(21) Appl. No.: 10/248,941

(22) Filed: Mar. 4, 2003

(51) Int. Cl.[7] ..... A63B 55/00
(52) U.S. Cl. ..... 248/96; 206/315.3
(58) Field of Search ..... 248/96, 163.1, 248/165, 166, 434, 168, 169, 170, 171; 206/315.3, 315.7; 24/116 R, 132 R

(56) References Cited

U.S. PATENT DOCUMENTS 3,787,017 A * 1/1974 Sauer ..... 248/96
5,154,377 A * 10/1992 Suk ..... 248/96
5,735,398 A * 4/1998 Price ..... 206/315.3
5,813,527 A * 9/1998 Henrickson ..... 206/315.3
6,296,116 B1 * 10/2001 Schmidt et al. ..... 206/315.7
6,443,405 B1 * 9/2002 Han ..... 248/96

* cited by examiner

*Primary Examiner*—Leslie A. Braun
*Assistant Examiner*—Amy J. Sterling
(74) *Attorney, Agent, or Firm*—Mark P. White

(57) ABSTRACT

A combination carrying strap and support stand for a golf bag is used both for carrying the bag around a golf course, or as a stand for the bag when not being carried. The combination, having an open end and a closed end, utilizes a flexible strap section, attached to a pair of linear supports, the section capable of flexing in one direction only. The flexible strap section is made up of a series of identical link elements, a flexible bottom band, to which each link element bottom is contiguously affixed, and a flexible upper band, to which each link element is slideably attached. The upper band attaches to and activates a pair of support legs, attached to the flexible strap section at it lower end, which allows the bag to stand independently. A lower linear support which rotatably attaches to the golf bag allows the strap/stand to remain in either storage mode or operational mode.

11 Claims, 10 Drawing Sheets

COMBINATION CARRYING STRAP AND SUPPORT STAND

BACKGROUND OF INVENTION

The prior art contains many examples of different types of stands to support golf bags when a golfer using the bag is taking a shot, or other wise occupied. A variety of different stands of different types, makes, and models are available, and carts or trolleys for both transporting and supporting the bag are also available.

The need for such a device is obviated when the golfer uses a caddy, or a motorized golf cart in which the bag can be kept in an upright position while the golfer removes the club desired.

A number of golfers do no use either caddies or motorized golf carts, but prefer, instead, to carry the bag on their shoulders, placing the bag down on the ground when the taking a shot. However, without a stand to support the bag, the bag must be laid down on the ground, as it will not support itself. Laying the bag on the ground results in soiling the bag, and many golfers are irritated by the constant laying down of the bag and picking up at every shot. Thus the popularity of various types of small supporting devices, sometimes fitted with wheels so that the golf bag can be pulled rather than carried.

However, almost all of these prior art devices are cumbersome, difficult to transport, and take up unneeded space in the storage area, basement, or garage.

The present invention provides a solution in the form of a device which serves as both a carrying strap and as a support for the bag when not being carried. The current invention provides a unique strap which can bend and flex along the golfer's shoulder in one configuration, but which converts into a rigid support member in a second configuration. The invention further contains spreadable support legs attached to the strap, and which convert the flexible strap into a robust, reliable structure for supporting the bag in an upright position on the ground.

The device of this invention is relatively inexpensive, and, in combination with a universal adapter, can be quickly and easily used with virtually any golf bag.

SUMMARY OF INVENTION

It is an object of the present invention to provide a combination strap and support for a golf bag which is flexible to allow comfort in the carrying of the bag, and which provides sufficient support to hold the golf bag in a substantially upright position on the ground without any other means of support.

In accordance with one aspect of the invention, the combination strap/support includes a flexible strap section, attached to the linear supports, the section capable of flexing in one direction only, and remaining unflexed in the other direction.

In accordance with a second aspect of the invention, the flexible strap section includes a multiplicity of link elements, including a first link and a last link, each link having a bottom and a top, a flexible bottom band, to which each link element bottom is contiguously affixed, a flexible upper band, to which each link element is slideably attached.

In accordance with a third aspect of the invention, one or more adjustable-length lower supports are affixed to the lower end of the flexible strap section, each rotatably attaching to the golf bag in proximity to its closed end.

In accordance with a fourth aspect of the invention, the lower support further includes one or more nested, extensible members which can be locked in an extended or retracted configuration.

In accordance with a fifth aspect of the invention the combination has one or more support legs, attached to the flexible strap section at it lower end.

In accordance with a sixth aspect of the invention combination strap and stand includes a locking mechanism for maintaining the upper band in one of two stable positions, the first, or open position, allowing the combination to be used either as a carrying strap or as a stand, and the second, or storage position, allows the combination to occupy a minimum space on the floor of a storage area.

In accordance with a seventh aspect of the invention, manual means are provided to configure the support legs in either the spread configuration or the closed configuration.

In accordance with an eighth aspect of the invention the locking mechanism includes a base, an arcuate spring having a first and second end, and a jam plate having a lower and upper end , rotatingly attached at its lower end to the base, rotatingly attached at the upper end to the first end of the arcuate spring, and rotatingly attached between the upper and lower ends to the upper band.

In accordance with a ninth aspect of the invention, the flexible strap section is enclosed in a fabric material, making it more comfortable when used to carry a golf bag on the user's shoulder.

In accordance with a final aspect of the invention the combination strap and stand includes linear supports affixed to the locking mechanism base.

BRIEF DESCRIPTION OF DRAWINGS

These, and further features of the invention, may be better understood with reference to the accompanying specification and drawings depicting the preferred embodiment, in which:

FIG. 8A depicts a perspective view of the lower strap assembly and support legs in spread position.

DETAILED DESCRIPTION

The present invention may be understood with reference to the drawings, in which each reference number used to refer to a particular element is maintained from one drawing to another.

Figure 1:
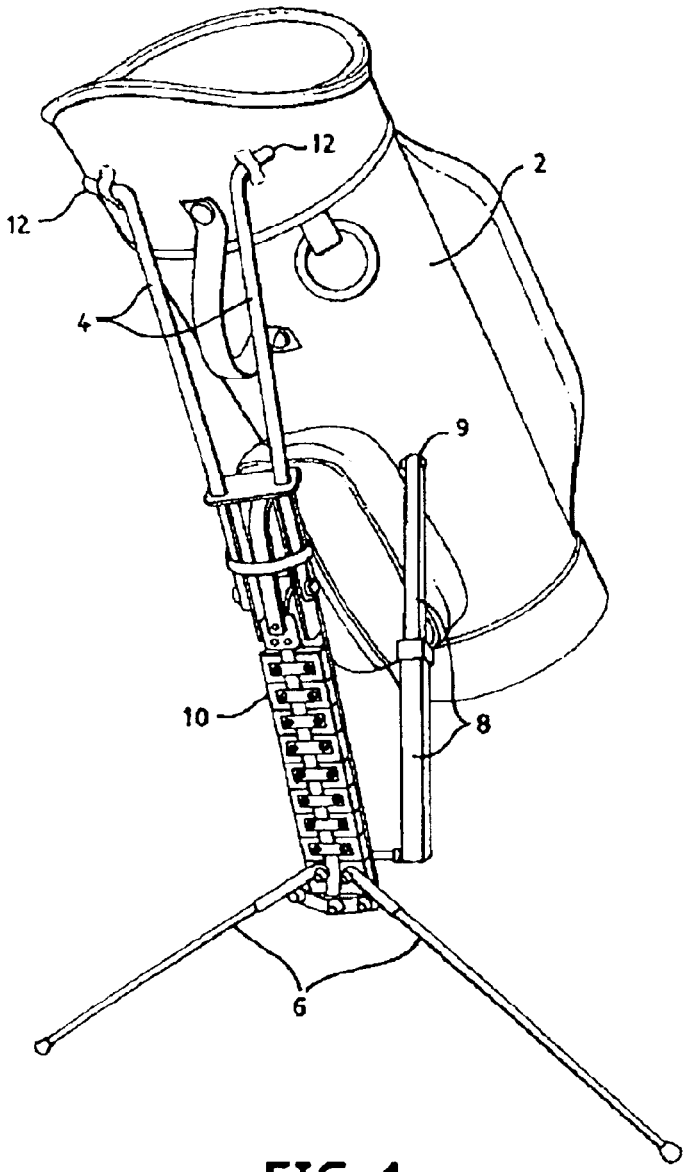
FIG. 1 depicts a perspective view of the golf bag with attached combination strap/stand configured to act as a stand.

Referring first to FIG. 1, a golf bag 2 is shown resting on the strap/support combination of the present invention, configured as a stand or support.

The strap/support combination includes the strap body 10, which is composed of a number of identical links which allow the strap body to bend away from the golf bag, but not toward it. These links, mounted on a lower band 26, form a linkage assembly, which will bend away from the bag to allow the combination to be used as a strap for carrying the golf bag, but will bend on slightly toward the bag, allowing it to function as a support. Although the links are visible in FIG. 1, in normal use the strap body is covered with a fabric, typically leather or a synthetic heavy-duty material to make the strap body more comfortable to carry.

At the bottom of the strap body are a pair of support legs 6, which may be rotated apart to support the golf bag, as shown in FIG. 1, or may be rotated together parallel to each other when the combination is configured for use as a strap, or when the golf bag is being stored.

Still referring to FIG. 1, a pair of linear supports 4 are connected from the top of the linkage assembly to the upper part of the golf bag. The connection in this embodiment is made by forming the upper end of each linear support into a right angle, more or less, forming linear support hooks 12, and inserting the linear support hooks into a mating loop of material, allowing the linear supports to rotate relative to the golf bag. Thus, when the combination is in the strap configuration, the linear supports will rotate freely relative to the golf bag.

The linear supports are adjustably attached to the strap assembly, to that the strap may be made longer or shorter to accommodate golfers of different sizes.

At the other end of the golf bag a slide assembly attaches the strap assembly to the lower portion of the golf bag. The slide assembly is made up of a larger, lower slide assembly 8 which rotates relative to the strap body, and also relative to the bag at rotating joint 9. The slide assembly has two positions: fully extended, as shown in FIG. 1, and fully retracted, whereby the upper slide assembly is fully retracted into the lower slide assembly. The retracted position is use mainly for storage, so that the strap body may be brought as close to the golf bag body 2 as possible, so that the bag takes up less space as the configuration of FIG. 1. Means are provided to lock the upper slide relative to the lower slide by one of many well-known mechanisms, such as the use of a wingnut or clip on the lower slide assembly where the upper slide assembly enters.

Figure 2:
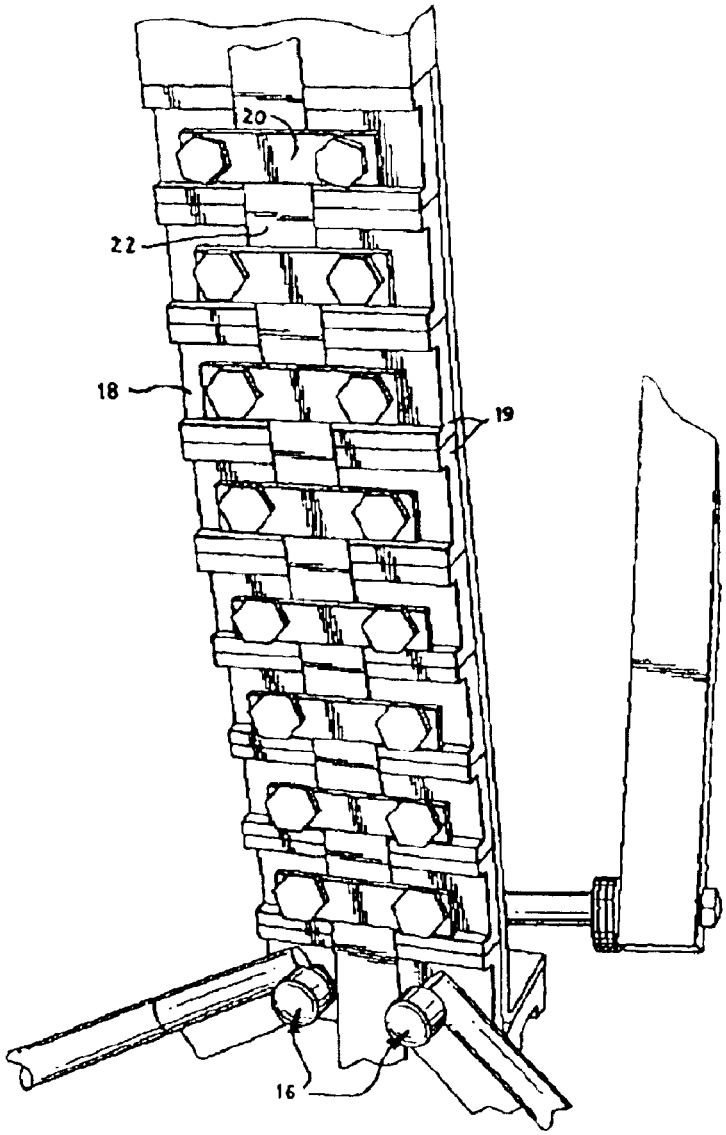
FIG. 2 depicts a perspective view of the link assembly from the top side, showing the detail of the attachment of the support legs and of the lower slide assembly.
Figure 3:
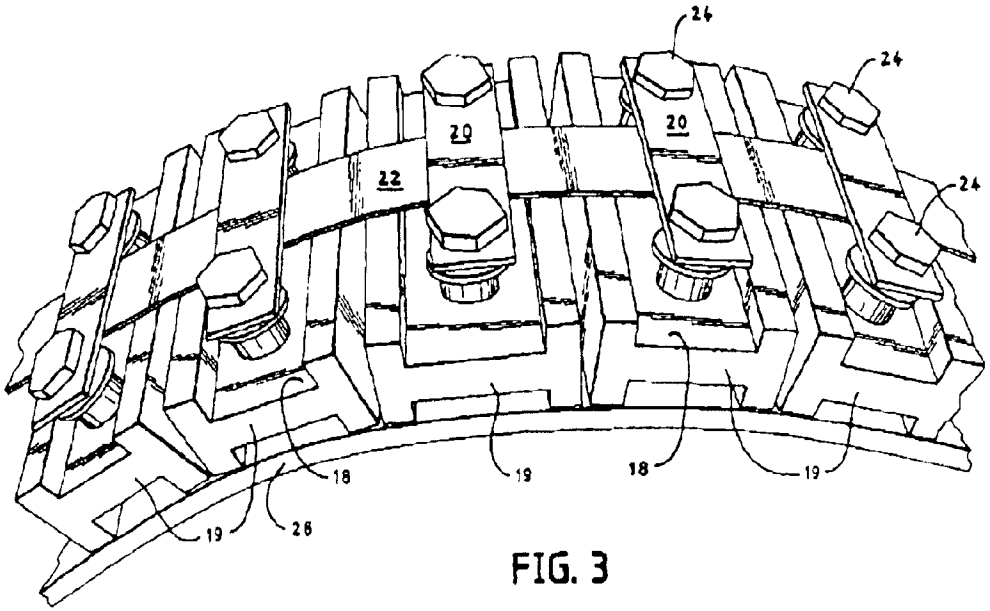
FIG. 3 depicts a perspective view of the link assembly from the top side, with the assembly flexed for use as a carrying strap.

Referring now to FIGS. 2 and 3 the detail of the linkage assembly may be seen and understood The bottom of the linkage assembly contains attachment points 13 of the support legs by means of screw or bolts which pass through the upper ends of the support legs, and through the lowest link of the array. The links 19 are identical to each other, and are affixed to a lower flexible band 26, which is approximately the same width as the links. The method of attachment of the each of the links to the lower band in this embodiment is by a pair of bolts 24, each of which passes through a thru hole in the link, through a thru-hole in the lower flexible band, and then secured at the other side of the lower flexible band with a nut.

As may be seen from referring to FIG. 3, each link has a recessed area 18. A smaller flexible upper band 22 spans the link elements 19, and is confined in its motion by the combination of the cross straps 20, and the bolt assemblies 24. Each of the identical bolt assemblies include standoffs, which elevate the cross straps 20, so that they allow the flexible upper band to slide freely across the tops of the link elements.

Still referring to FIG. 3, it is seen that the link assembly can flex in the direction shown in the Figure, but cannot flex in the opposite direction, however, as the side walls of contiguous link elements will contact each other at right angles when the lower flexible band is flat and perpendicular to the side walls, and will go no further.

Figure 5A:
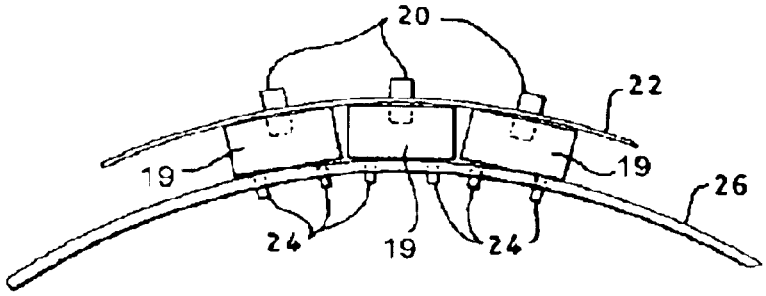
FIG. 5A depicts a side elevation view of the link assembly flexed for use as a carrying strap.
Figure 5B:
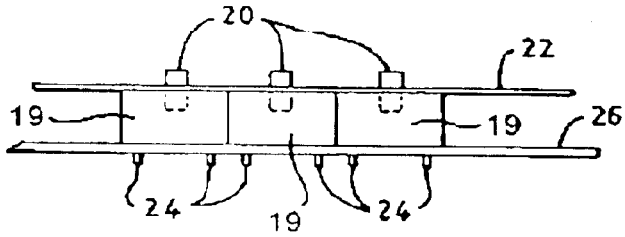
FIG. 5B depicts a side elevation view of the link assembly straightened for use as a stand.

Referring now FIGS. 5A and 5B, the mechanism of limiting the bend to one direction is further illustrated. In FIG. 5A the lower band 26 bends in a direction which allows tops of contiguous link elements to separate , and which allows even further bending in the same direction. The bottoms of the contiguous link elements are always in contact, however, regardless of how far the lower band is bent. The bottom of the bolt assemblies 24 is seen beneath the lower band. 26.

In FIG. 5B, however, the configuration has reached its limit when the bottom band 26 is displaced upward at the ends. It is clear that even with further pressure upwards at the ends of the bottom band 26, the link assembly will not bend further in direction shown.

The position of the support legs is controlled by the upper band 22, which slides freely between the cross straps 20, so that force may be transmitted from the top of the upper strap to the mechanism which controls the support legs. The upper band must be made of a strong but flexible material, such as stainless steel, which may bend, but will not buckle, so both tensile and compressive force may be transmitted along the upper band.

Figure 8A:
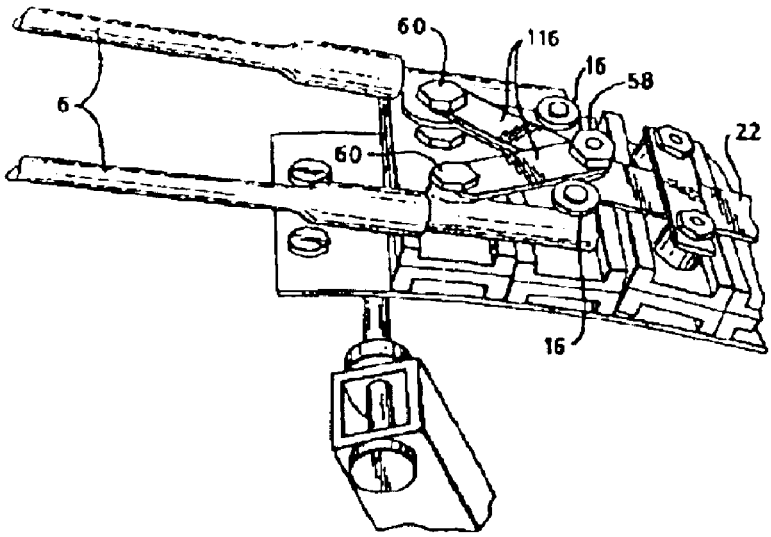
FIG. 8A depicts a perspective view of the lower strap assembly and support legs in closed position.

Referring first to this control mechanism, and referring to FIGS. 2, 8*a,* and 8*b,* it is seen that the support legs rotate at their upper ends about leg pivot bolts 16, which are also fastened to one of the link assemblies. Somewhat lower, each leg 6, together with the lower end of one of the leg actuation links 116, is constrained by a leg actuation linkage attachment bolt 60, each of which is attached to one of the support legs 6, but not to the underlying structure of the strap body. The upper end of each linkage is further constrained by the leg actuation linkage rotation bolt 58, which is attached to the lower end of the upper band 22, but not to the underlying structure of the strap body.

Figure 8B:
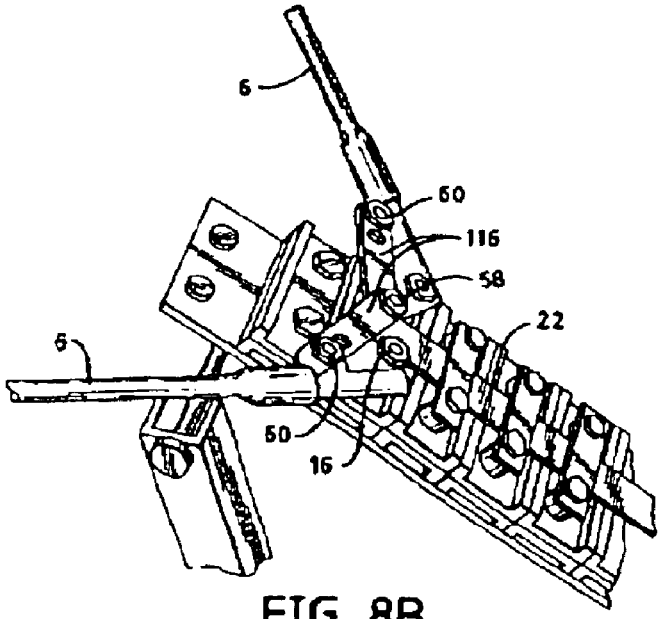

Thus, when the upper band transmits force downward from the configuration of FIG. 8*a,* the leg actuation linkage rotation bolt 58 moves downward also, causing the leg actuation links to spread apart, spreading the support legs apart as well. Referring to FIG. 8*b,* the spread configuration of the support legs is seen, wherein the leg actuation linkage rotation bolt 58 has moved downward so that is below the level of the leg pivot bolts 16, which are constrained to remain fixed in position relative to the strap body.

Figure 6:
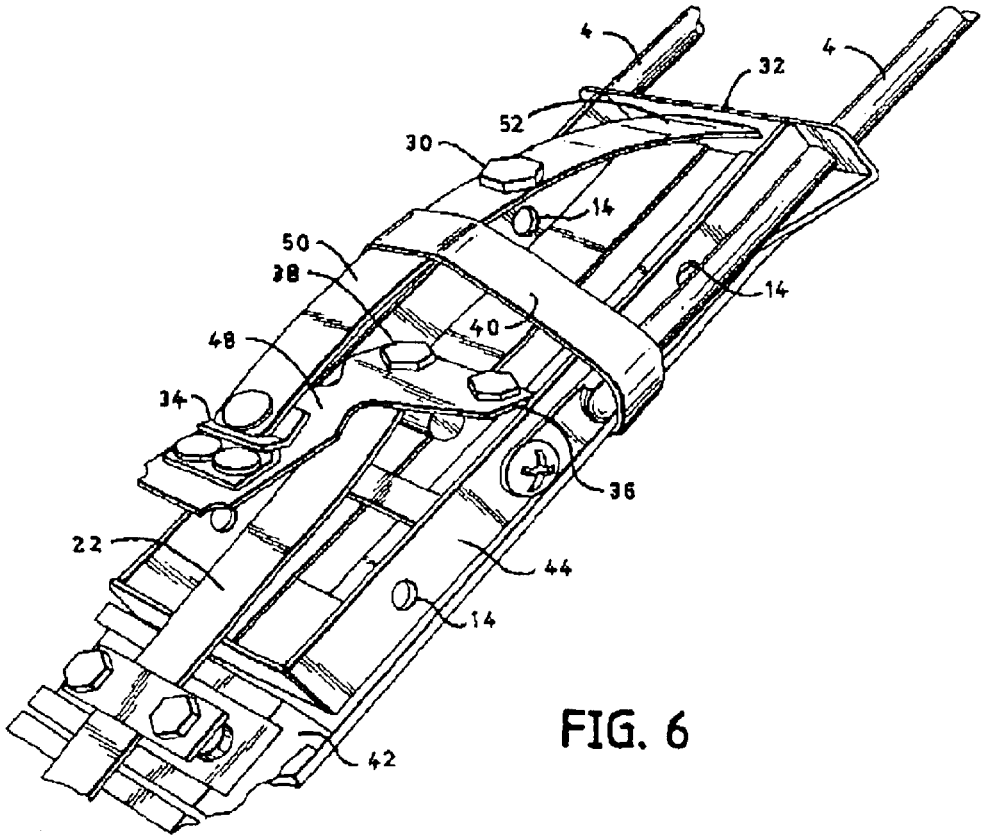
FIG. 6 shows a perspective view of the locking assembly in closed, or operating position, for use as a strap or as a stand.

Referring now to FIG. 6, the termination of the upper band is shown in detail. In the position shown the upper band is forced downward, spreading the support legs as described above when the strap is in a substantially horizontal position, as seen in FIG. 1. However, when the strap body is bent, as shown in FIGS. 3 and 5A, the upper band pulls the support legs into a closed, parallel position.

Figure 7:
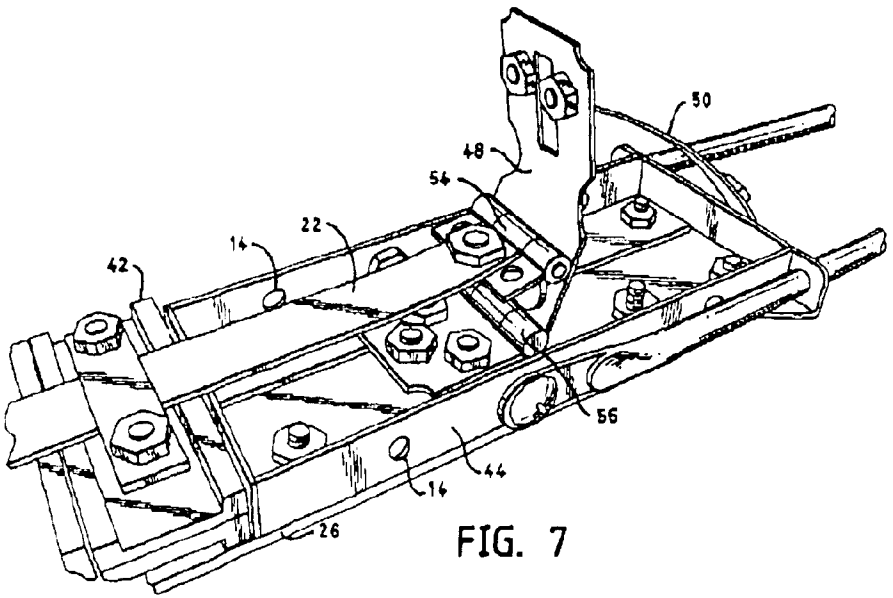
FIG. 7 depicts a perspective view of the locking assembly in open, or override position, for use in storage configuration.

The locking mechanism of FIGS. 6 and 7 provide a means to manually control the upper band, and to allow the user to open or close the support legs regardless of the position of the upper strap.

Referring now to FIG. 6, which shows the locking mechanism in its closed, or automatic state, the locking mechanism includes locking assembly body 44, which is affixed to the lower band 26 in proximity to the last, or uppermost link element 42. The upper band 22 is seen to terminate at the jam plate 36. The jam plate is attached at its lower end, or base, to the body 44 of the locking assembly through a hinge 56, so that it rotates at that point. Likewise, the upper end of the jam plate 36 is attached to the arcuate locking spring 50 by another rotating hinge member 54.

The arcuate locking spring has two stable positions, open and closed. The free end 52 of the arcuate locking spring is forced against the back plate 32 of the locking assembly body, so arcuate locking spring remains in its closed position. An elastic restraining band 40 further maintains the free end 52 of the arcuate locking spring against the back plate 32. Referring next to FIG. 7, the locking assembly is shown in the open state, or manual override state, whereby the upper band is relaxed, and the user may move the upper band either upward or downward by rotating the jam plate 48 upward or downward, to either close or open the support legs.

Still referring to FIG. 7, the jam plate 48, is attached to the upper band 22 through upper jam plate hinge assembly 54. Also displayed is lower jam plate hinge assembly 56 by which the jam plate 48 is attached to the locking assembly body 44. This figure further shows the method of attachment of the lower end of the linear supports 4 to the locking assembly base 44. A number of pairs of attachment points 14 in the form of holes drilled into the side of the assembly body allow for the lengthening or shortening of the overall length of the strap, so that the strap may be adjusted to the dimensions of the user.

Figure 4:
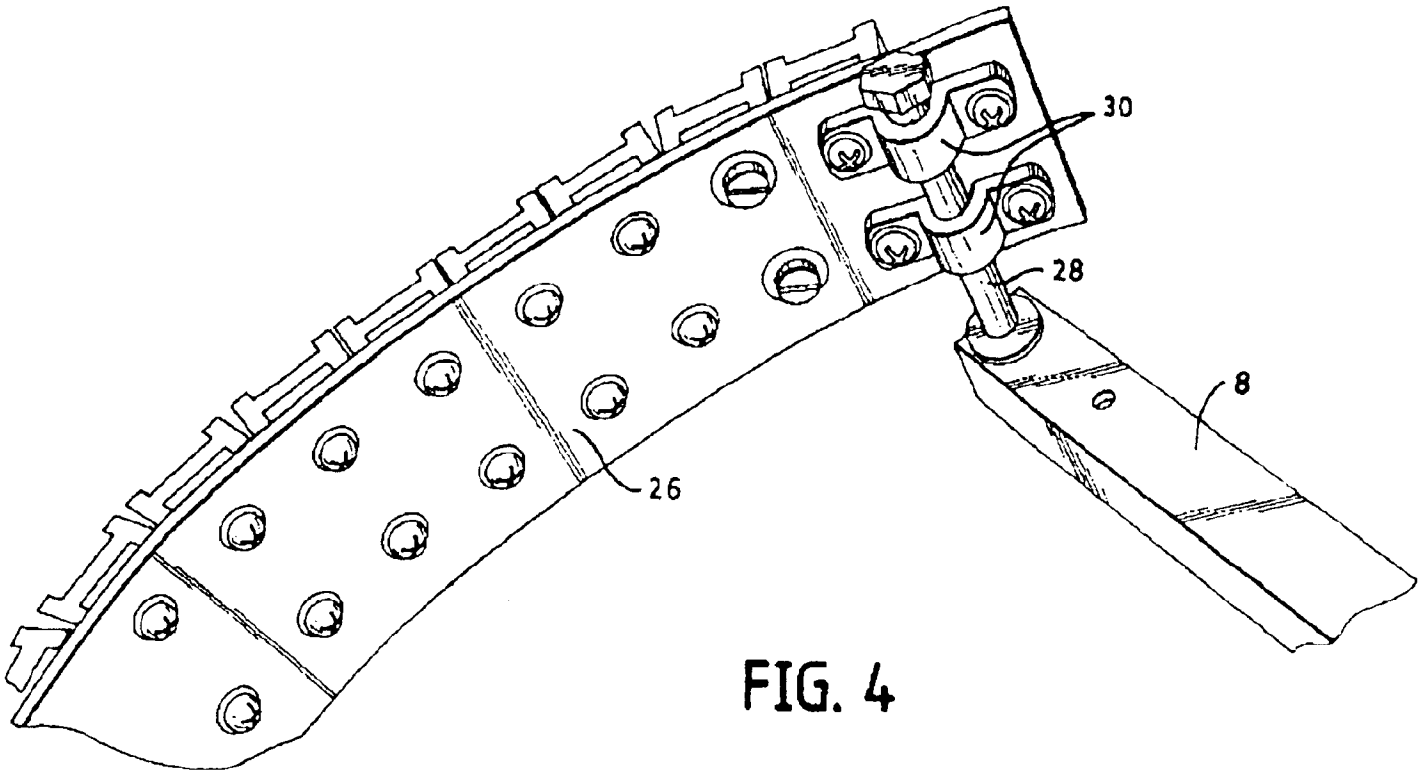
FIG. 4 depicts a perspective view of the link assembly from the bottom side, showing detail of the attachment of the lower slide assembly.

Referring now to FIG. 4, the under side of the link assembly is shown, together with the connection of the slide assembly lower arm 8 to the link assembly. The slide assembly contains a perpendicular shaft 28 rotatably attached to the slide assembly lower arm 8. This shaft 28 is secured to the flexible lower band 26 of the link assembly by means of two gudgeons 30, thus allowing the slide assembly to rotate with respect to the slide assembly.

The entire link assembly is covered with a fabric or other sheet material, such as leather or its synthetic equivalents, for both cosmetic purposes and for enhanced comfort when the golf bag is being carried by disposing the link assembly on the shoulder of the user.

Figure 9:
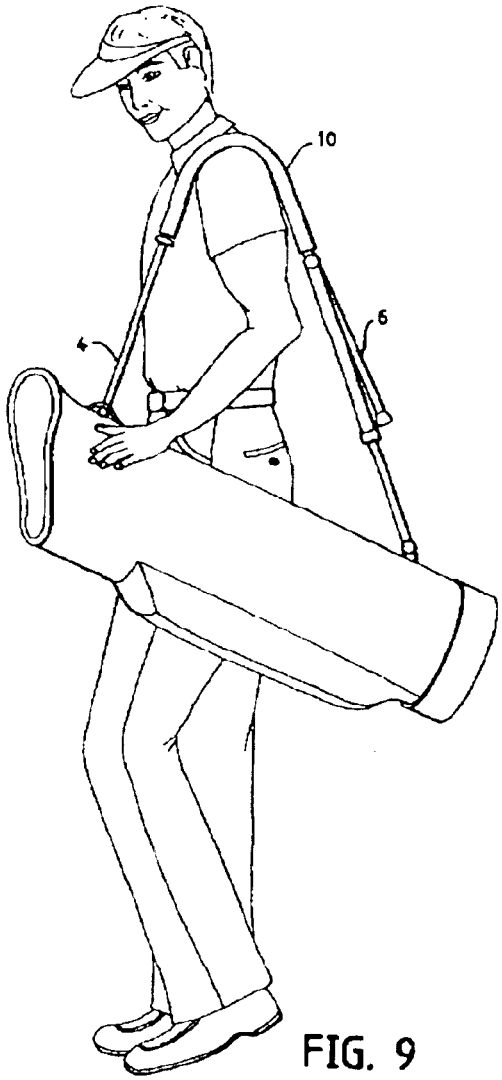
FIG. 9 depicts a drawing of a golfer carrying a golf bag using the present invention.

FIG. 9 shows the strap in a configuration wherein the user is carry the golf bag on his shoulder. It is noted that the strap now consists of an upper portion of the linear supports 4, which remains substantially linear in configuration, although does have the ability to flex somewhat; a central strap body 10, which is flexible in a single direction, as previously described; and the lower slide assembly, which includes a slide assembly upper and lower arm, which are also substantially linear in configuration. The support support legs now are in closed configuration, and trail behind the lower end of the strap body.

Removeable Strap Embodiment. In the first preferred embodiment, as described above, the upper linear supports and the lower slide assembly were both affixed directly to the golf bag, so that the golf bag would either have to manufactured using the strap described herein permanently affixed to the golf bag, or the bag would have to be modified after manufacture so accommodate the strap, the modification resulting in the strap being permanently affixed to the golf bag.

In a second embodiment, as shown in FIG. 10, the strap is permanently attached to a universal adapter, which is removeably attachable to almost any golf bag, so that existing bags may use the current invention without requiring any permanent modification to the golf bag.

Figures 10A, 10B, 10C, 10D:
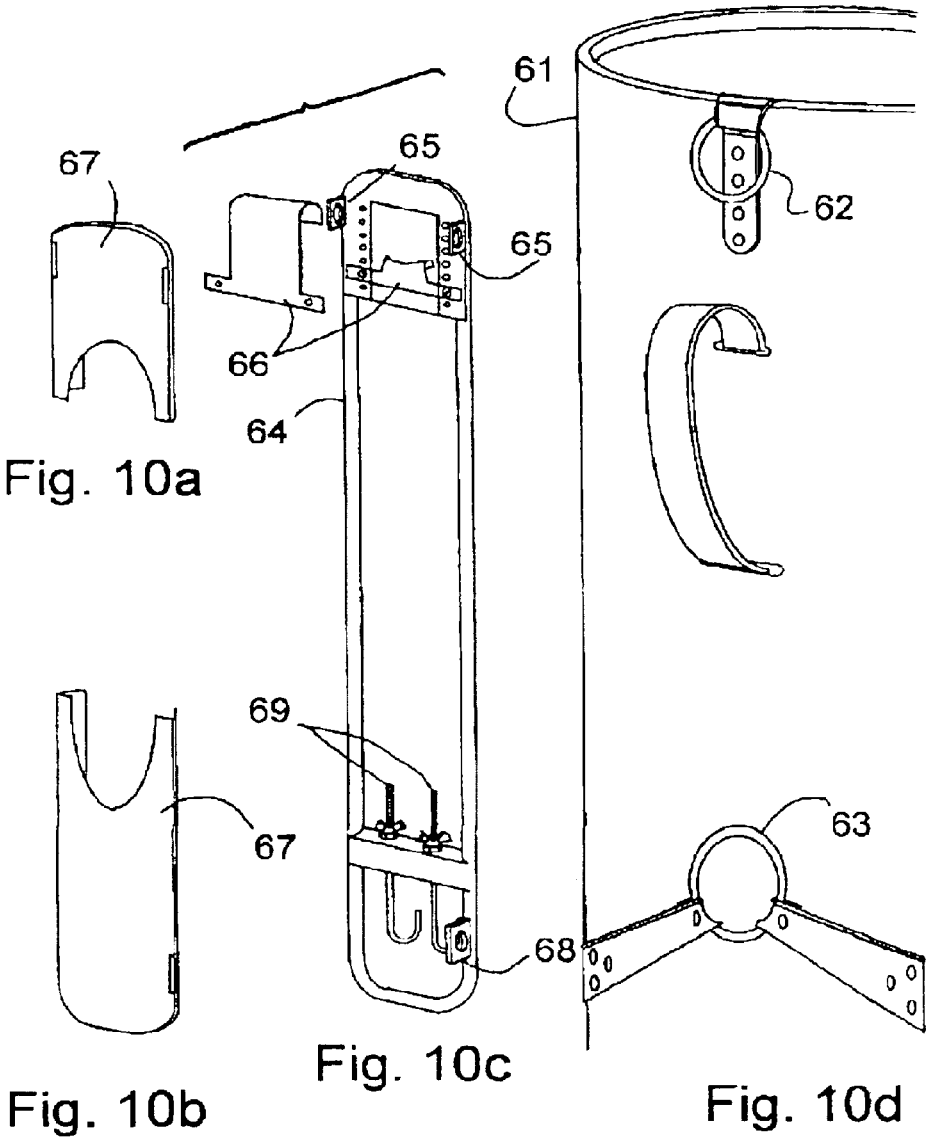
FIG. 10*a* depicts an upper cover of the universal adapter.
FIG. 10*b* depicts a lower cover of the universal adapter.
FIG. 10*c* depicts the adapter body.
FIG. 10*d* depicts the attachment points for the universal adapter on the golf bag.

Referring now to FIG. 10*d,* the universal adapter may be used on any existing golf bag 61 by first removing the standard shoulder strap from attachment points 62 and 63, and replacing it with the universal adapter at these attachment points. The universal adapter converts the many different strap connection configurations to a standard pattern to accept the mounting of the strap stand.

The upper and lower attachment points shown in FIG. 10 represent the most common strap attachment configuration currently in general use. The attachment points consist of a pair of metal rings secured to the bag by mean of leather strapping which is either stitched or riveted.

Referring now to FIG. 10*c,* the universal adapter includes of an adapter body 64, which is attached to the golf bag by means of an upper clip 66, and mounting rods 69. In this embodiment 3/16 inch threaded rods are attached to the adapter body, with hooks on the lower end, and wingnuts on the upper end. After the upper clip is affixed to the upper attachment point 62, the mounting rods are hooked onto the lower attachment point 63, and the connection is tightened by means of the wingnuts. As a result, the adapter body is securedly and tightly attached to the body of the golf bag.

The adapter body 64 is the rigid base framework made of a metal or high strength plastic that is capable of supporting the weight of a fully loaded golf bag. In this embodiment the sides of the adapter body are made of a ¼ solid rod. The other parts of the adapter body are ether welded to the rods, or, as an alternative, the adapter body may be case in one piece. The adapter body is approximately 17 inches long and 2 inches wide. When this frame is attached to the bag it will allow the golf bag carrying handle to pass through the frame so that it may be used with the universal adapter in place.

Once the adapter body is firmly attached to the golf bag, the upper and lower covers 67 are snapped into place, as seen in FIGS. 10*a* and 10*b*. The linear arm support hooks, shown in FIG. 1, mate with the arm attachment points 65 which protrude through the upper cover. The slide assembly lower arm 11, shown in FIG. 1, mates with the slide attachment point 8, which protrudes through the lower cover.

When the strap-stand has been attached to the golf bag, as described above, it functions in the same way as the first embodiment, in which the strap stand attached directly to the golf band. The second embodiment requires that the golf bag has rings as attachment points, as shown in FIG. 10*d*. However, it is clear that other types of attachment points of the carrying strap may be used to attach universal adapters with other methods of connection. The universal adapter, to which the strap-stand is applied, has the obvious advantage of being easily adaptable to existing golf bags, without the requirement of buying a new golf bag with the strap-stand already installed.

While the invention has been described with reference to specific embodiments, it will be apparent that improvements and modifications may be made within the purview of the invention without departing from the scope of the invention defined in the appended claims.

I claim:

1. A combination carrying strap and support stand for a golf bag, having an open end and a closed end, comprising:

(a) one or more upper supports which rotatingly attach to the golf bag in proximity to said open end;

(b) a flexible strap section, having an upper and lower end, and attached to the upper supports, the section capable of flexing away from the golf bag, but not toward it;

(c) one or more support legs, each attached to the flexible strap section at its lower end; and (d) one or more adjustable-length lower supports, each affixed to the lower end of the flexible strap section, and which rotatably attaches to the golf bag in proximity to its closed end.

2. A combination carrying strap and support stand for a golf bag, having an open end and a closed end, comprising:

(a) a universal mount, attaching at an upper end in proximity to the open end of the golf bag, and at a lower end in proximity to the closed end of the golf bag;

(b) one or more upper supports which rotatingly attach to the golf bag in proximity to said upper end of the universal mount;

(c) a flexible strap section, having an upper and lower end, and attached to the upper supports, the section capable of flexing away from the golf bag, but not toward it;

(c) one or more support legs, each attached to the flexible strap section at its lower end; and (d) one or more adjustable-length lower supports, each affixed to the lower end of the flexible strap section, and which rotatably attaches to the universal support in proximity to its lower end.

3. The combination strap and stand of claim 1 or 2, wherein the flexible strap section further comprises:

(a) a multiplicity of link elements, each further comprising a bottom and two sides perpendicular to the bottom, each side contiguously disposed relative to each adjacent link element; and (b) a flexible bottom band, to which each link element bottom is affixed.

4. The combination strap and stand of claim 3, wherein the number of support legs is two or more, wherein the legs further comprise a spread configuration and a closed configuration, and further comprising means to change said configuration from spread to open, and vice versa.

5. The combination strap and stand of claim 3, wherein the means to change said configuration further comprises a flexible upper band, having an upper and lower end, constrained to slide in proximity with each link element, the lower end of said upper band linkeably attached to the support legs.

6. The combination strap and stand of claim 4, wherein the lower support further comprises one or more extensible members which can be locked in an extended or retracted configuration.

7. The combination strap and stand of claim 5, further comprising manual means to configure the support legs in either the spread configuration or the closed configuration.

8. The combination strap and stand of claim 6, further comprising means to adjust the length of the upper supports.

9. The combination strap and stand of claim 7, further comprising a covering of fabric which encloses the flexible strap.

10. The combination strap and stand of claim 9, further comprising a locking mechanism which comprises:

a base;

an arcuate spring having a first and second end; and a jam plate having a lower and upper end, rotatingly attached at its lower end to the base, rotatingly attached at the upper end to the first end of an arcuate spring, and rotatingly attached between the upper and lower ends to the upper band.

11. A method of using the combination carrying strap and support stand of claim 1 or 2, comprising the steps of:

(a) maintaining the locking mechanism in a closed configuration;

(b) carrying the bag by means of the combination strap and stand with the locking mechanism in a closed configuration;

(c) supporting the bag in a standing position with the locking mechanism in a closed configuration;

(d) maintaining the locking mechanism in an open configuration;

(e) manually moving the support legs into a closed configuration;

(e) adjusting the adjustable-length lower supports to a minimum length;

(f) moving the combination strap and stand in proximity to the golf bag along its entire body; and (g) storing the golf bag in the configuration of step (f).

* * * * *